US009484640B2

(12) United States Patent
Yamaji et al.

(10) Patent No.: US 9,484,640 B2
(45) Date of Patent: Nov. 1, 2016

(54) WIRE WITH A CRIMP TERMINAL WITH A BOTTOM PLATE WITH AN INCLINED PORTION AND A RAISED PORTION

(71) Applicant: Sumitomo Wiring Systems, Ltd., Yokkaichi, Mie (JP)

(72) Inventors: Ayumi Yamaji, Mie (JP); Hiroaki Imai, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 14/888,500

(22) PCT Filed: Apr. 28, 2014

(86) PCT No.: PCT/JP2014/061863
§ 371 (c)(1),
(2) Date: Nov. 2, 2015

(87) PCT Pub. No.: WO2014/185262
PCT Pub. Date: Nov. 20, 2014

(65) Prior Publication Data

US 2016/0087350 A1 Mar. 24, 2016

(30) Foreign Application Priority Data

May 17, 2013 (JP) ..... 2013-104616

(51) Int. Cl.
*H01R 4/10* (2006.01)
*H01R 4/18* (2006.01)
(Continued)

(52) U.S. Cl.
CPC *H01R 4/18* (2013.01); *H01R 4/62* (2013.01); *H01R 43/0488* (2013.01); *H01R 4/185* (2013.01)

(58) Field of Classification Search
CPC ..... H01R 4/18; H01R 4/62; H01R 4/184; H01R 4/185; H01R 4/188
USPC ..... 439/877, 882, 884, 887, 421
See application file for complete search history.

(56) References Cited

U.S. PATENT DOCUMENTS 5,500,999 A * 3/1996 Yagi ..... H01R 43/058 29/751
7,789,715 B2 * 9/2010 Noda ..... H01R 4/185 439/730

(Continued)

FOREIGN PATENT DOCUMENTS

JP 60-47386 3/1985
JP 2009-37909 2/2009

(Continued)

OTHER PUBLICATIONS

International Search Report.

*Primary Examiner* — Chandrika Prasad
(74) *Attorney, Agent, or Firm* — Gerald E. Hespos; Michael J. Porco; Matthew T. Hespos

(57) ABSTRACT

It is aimed to provide a wire with terminal in which small connection resistance and a large fixing force are easily combined and a core crimping portion is unlikely to be cracked in a crimping step of the core crimping portion. In a wire with terminal, a core crimping portion includes a bottom plate portion for supporting a core and a pair of core caulking portions sandwiching the core between the core caulking portions and the bottom plate portion. The bottom plate portion of the core crimping portion is shaped to include an inclined portion recessed gradually deeper toward the pair of core caulking portions from a first end side toward a second end side of a crimping terminal.

3 Claims, 7 Drawing Sheets

(51) Int. Cl.
*H01R 4/62* (2006.01)
*H01R 43/048* (2006.01)

(56) References Cited

U.S. PATENT DOCUMENTS

| | | | | |
|---|---|---|---|---|
| 7,905,745 | B2 | 3/2011 | Watanabe et al. | |
| 8,221,171 | B2 | 7/2012 | Ono et al. | |
| 8,963,006 | B2 * | 2/2015 | Kuwayama | H01R 4/185 174/113 A |
| 9,048,607 | B2 | 6/2015 | Ito | |
| 2002/0022414 | A1 * | 2/2002 | Kitagawa | H01R 4/184 439/877 |
| 2010/0144189 | A1 | 6/2010 | Watanabe et al. | |
| 2010/0261391 | A1 | 10/2010 | Ono et al. | |
| 2011/0073365 | A1 | 3/2011 | Kuwayama et al. | |
| 2011/0136397 | A1 * | 6/2011 | Koga | H01R 4/185 439/877 |
| 2012/0231678 | A1 * | 9/2012 | Shinmi | H01R 4/184 439/878 |

FOREIGN PATENT DOCUMENTS

| | | |
|---|---|---|
| JP | 2009-117039 | 5/2009 |
| JP | 2009-123620 | 6/2009 |
| JP | 2010-140651 | 6/2010 |
| JP | 2013-73877 | 4/2013 |

* cited by examiner

WIRE WITH A CRIMP TERMINAL WITH A BOTTOM PLATE WITH AN INCLINED PORTION AND A RAISED PORTION

BACKGROUND

1. Field of the Invention

The present invention relates to a wire with terminal including a crimp terminal mounted on an end part of an insulated wire.

2. Description of the Related Art

In the case of mounting a crimp terminal on an end part of an insulated wire, it is important that a fixing force at a crimped part is sufficiently large and connection resistance between a core and the crimp terminal is sufficiently small.

Note that the fixing force is a force required to separate the crimp terminal and the insulated wire when a force acting in a direction to pull the insulated wire from the crimp terminal is applied to a wire with terminal. Further, the connection resistance is electrical resistance between the core (conductor of the insulated wire) and the crimp terminal in the wire with terminal.

As described in Japanese Unexamined Patent Publication No. 2009-37909, a relationship of a degree of compression of a core by a core crimping portion of a crimp terminal, connection resistance and a fixing force in a wire with terminal is as described below. Note that, in the following description, a large degree of compression of the core means a small compression ratio of the core or a small crimp height of the core crimping portion. The compression ratio of the core is a ratio of a cross-sectional area of the core after compression to an initial cross-sectional area of the core. The crimp height is a height from the bottom surface to the top surface of the core crimping portion crimped to the core.

Specifically, the connection resistance is sufficiently small if the degree of compression of the core is within a predetermined proper range. However, the connection resistance increases to such an extent unsuitable for use if the degree of compression of the core falls below or exceeds that proper range.

Further, in the case that the degree of compression of the core is within a range capable of suppressing the connection resistance to a sufficiently low level, the fixing force increases as the degree of compression of the core becomes smaller. Further, in the actual wire with terminal, the degree of compression of the core varies and a correlation of the degree of compression of the core, the connection resistance and the fixing force also varies.

Accordingly, in a conventional general manufacturing process of a wire with terminal, it is necessary to strictly manage parameters of a crimping step relating to the suppression of the variation of a degree of compression of a core to reliably satisfy specifications required for connection resistance and a fixing force.

Particularly, in the case of adopting a so-called aluminum wire, a range of a degree of compression of a core to combine connection resistance and a fixing force becomes narrower and it is more difficult to combine the connection resistance and the fixing force. Note that the aluminum wire is an insulated wire including a core mainly containing aluminum and an insulation coating.

Further, in the wire with terminal shown in Japanese Unexamined Patent Publication No. 2009-37909, a part of the core crimping portion on a tip side (contact portion side) is more strongly crimped to have a higher degree of compression of the core than a part on a base end side (coating crimping portion side).

More specifically, on a bottom plate portion of the core crimping portion shown in Japanese Unexamined Patent Publication No. 2009-37909, a widthwise central part is formed without any step in a longitudinal direction of the wire. Further, parts of the bottom plate portion at opposite sides of the central part are recessed deeper in partial areas on the tip side than in the remaining areas on the base end side. Thus, steps as boundaries between the areas on the tip side and the areas on the base end side are formed at the opposite sides of the central part on the bottom plate portion of the core crimping portion.

The bottom plate portion and a pair of caulking portions of the core crimping portion are pressed by an anvil (upper die) and a crimper (lower die) of a crimping machine when the core crimping portion is crimped to the core. Note that, in the core crimping portion, the bottom plate portion is a part for supporting the core and the pair of caulking portions are parts to be folded toward the core.

If the wire with terminal shown in Japanese Unexamined Patent Publication No. 2009-37909 is adopted, it is possible to crimp parts of the core crimping portion from the steps to the tip side with strength mainly suitable to reduce the connection resistance and crimp parts from the steps to the base end side with strength mainly suitable to increase the fixing force. As a result, the parameters of the crimping step in the manufacturing of the wire with terminal are easily managed.

Note that it is also important in the manufacturing of the wire with terminal that a crimped state of the crimp terminal to the insulated wire is easily detected and the crimper and the anvil constituting a die of the crimping machine are easily manufactured.

In the wire with terminal shown in Japanese Unexamined Patent Publication No. 2009-37909, it may become necessary to form larger steps on the core crimping portion to combine the connection resistance and the fixing force. For example, in the case of adopting a thick core or in the case of adopting a core made of easily fractured metal (brittle) such as an aluminum core, the steps of the core crimping portion need to be made larger.

However, it causes cracks in the core crimping portion to form large steps on the core crimping portion in the crimping step of the core crimping portion, i.e. in the pressing step.

The present invention aims to provide a wire with terminal in which small connection resistance and a large fixing force are easily combined and a core crimping portion is unlikely to be cracked in a crimping step of the core crimping portion.

SUMMARY

A wire with terminal according to one aspect of the invention includes an insulated wire and a crimp terminal. The crimp terminal includes a core crimping portion, a coating crimping portion and a contact portion. The core crimping portion is a part crimped to an end part of a core of the insulated wire. The coating crimping portion is a part formed on a first end side and crimped to a part of an insulation coating of the insulated wire. The contact portion is a part formed on a second end side and to be connected to a mating terminal. The core crimping portion includes a bottom plate for supporting the core and two core caulking portions folded to sandwich the core between the core caulking portions and the bottom plate and form ridges extending along a longitudinal direction of the insulated wire. Further, the bottom plate of the core crimping portion is shaped to include an inclined portion recessed gradually deeper toward the pair of caulking portions from the first end side toward the second end side.

The bottom plate of the core crimping portion may include a raised portion and two base portions. The raised portion may be raised toward a side opposite to the core in a widthwise central area while forming a ridge parallel to the ridges of the caulking portions. The two base portions may be parts including the inclined portions at opposite sides of the raised portion. In this specification, lines that are parallel means not only that the lines are strictly parallel, but also that the lines are substantially parallel.

The inclined portions of the pair of base portions on the bottom plate of the core crimping portion may be formed to be recessed gradually deeper toward the pair of caulking portions and may be gradually wider from the first end side toward the second end side.

The base portions on the bottom plate of the core crimping portion may further include parallel portions formed at sides of the inclined portions close to the second end side and having a constant interval to the pair of caulking portions in the longitudinal direction of the insulated wire.

The bottom plate of the core crimping portion further includes a parallel portion formed at a side of the inclined portion close to the second end side and having a constant interval to the pair of caulking portions in the longitudinal direction of the insulated wire. In this specification, that the interval is constant means not only that the interval is strictly constant, but also that the interval is substantially constant.

The bottom plate of the core crimping portion may be formed with a projection or a recess as a mark of a boundary position between the inclined portion and the parallel portion.

In each of the above aspects of the invention, the bottom plate of the core crimping portion may be shaped to include the inclined portion recessed gradually deeper toward the pair of caulking portions from the first end side (coating crimping portion side) toward the second end side (contact portion side) of the crimp terminal. Specifically, a part of the core crimping portion where the inclined portion is formed is crimped so that a degree of compression of the core gradually increases from the first end side toward the second end side.

Additionally, each of the above aspects makes it possible to crimp a part near the first end out of the part of the core crimping portion where the inclined portion is formed with strength mainly suitable to increase a fixing force and crimp a part near the second end with strength mainly suitable to reduce connection resistance. As a result, parameters of a crimping step in the manufacturing of the wire with terminal are managed easily and small connection resistance and a large fixing force are combined easily.

As described above, the shape of the inclined portion may form a recess on the bottom plate of the core crimping portion that moderately changes in the longitudinal direction of the insulated wire. Thus, in the crimping step of the core crimping portion, the core crimping portion is unlikely to be cracked even if an anvil (lower die) for forming such an inclined portion is pressed against the bottom plate portion.

As described above, the bottom plate portion of the core crimping portion may include the raised portion occupying the widthwise central area and the two base portions located at the opposite sides of the raised portion, and the inclined portion may be included in each of the base portions. Furthermore, the ridges of the caulking portions and that of the raised portion on the bottom plate portion are parallel.

As noted above, a crimp height of the core crimping portion may be constant in the longitudinal direction of the insulated wire although the inclined portions are formed on the bottom plate portion of the core crimping portion. Generally, the crimp height is an important inspection parameter for a crimped state of the crimp terminal. Accordingly, the crimp height may be inspected easily since a degree of freedom in the measurement position of the crimp height is high.

As noted above, the inclined portions of the two base portions may be recessed gradually deeper toward the two caulking portions and gradually wider from the first end side toward the second end side. As described later, a die (anvil) for forming such inclined portions can be manufactured easily at low cost by a step of forming a groove having a constant cross-sectional shape in a metal member and a step of obliquely cutting edge portions at opposite sides of the groove.

As noted above, the bottom plate portion of the core crimping portion may include the inclined portions and the parallel portions formed at the sides of the inclined portions close to the second end side. The parallel portions are parts having a constant interval to the pair of caulking portions in the longitudinal direction of the insulated wire. In this case, a compression ratio of the core is substantially equal in a cross-section at any position in the longitudinal direction of the insulated wire in the part of the core crimping portion including the parallel portion. The compression ratio of the core is an important inspection parameter for the crimped state of the crimp terminal. Accordingly, the compression ratio of the core may be inspected easily since a degree of freedom in the measurement position of the compression ratio of the core is high.

If an angle of the inclined portion to the parallel portion is very small, it is difficult to visually distinguish the parallel portion and the inclined portion. Thus, it is difficult to specify the measurement position of the compression ratio of the core. As described above, the bottom plate of the core crimping portion may be formed with the projection or the recess as a mark of a boundary position between the inclined portion and the parallel portion. As a result, the measurement position of the compression ratio of the core is specified easily by distinguishing the parallel portion and the inclined portion.

DETAILED DESCRIPTION

Hereinafter, embodiments are described with reference to the accompanying drawings. Each embodiment described below is a specific example of the present invention and not of the nature to limit the technical scope of the present invention. A wire with terminal described in each embodiment is applied to a wiring harness to be mounted in a vehicle such as an automotive vehicle.

Figure 1:
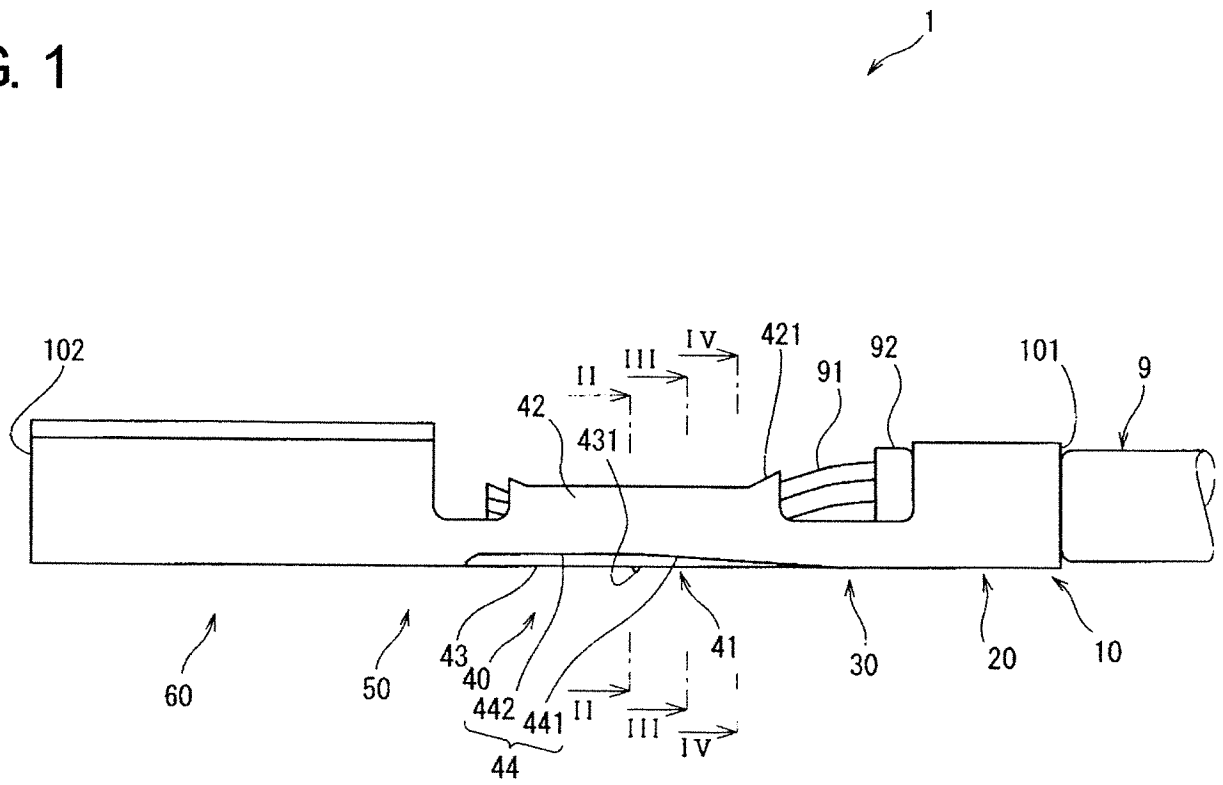
FIG. 1 is a side view of a wire with terminal 1 according to a first embodiment.

First, the configuration of a wire with terminal 1 according to a first embodiment is described with reference to FIGS. 1 to 4. As shown in FIG. 1, the wire with terminal 1 includes an insulated wire 9 and a crimp terminal 10 mounted on an end part of the insulated wire 9.

<Insulated Wire>

The insulated wire 9 on which the crimp terminal 10 is to be mounted is a wire including a core 91, which is a long conductor, and an insulation coating 92, which is an insulator surrounding the core 91. Normally, the core 91 is a twisted wire formed by twisting a plurality of strands formed of thin conductors. However, the core 91 is also conceivably a single-strand wire.

The end part of the insulated wire 9 is processed into a state where the insulation coating 92 is removed over a predetermined length from the periphery of the core 91, i.e. a part of the core 91 of the predetermined length extends from the insulation coating 92. The core 91 of the insulated wire 9 is, for example, a wire material of metal mainly containing copper or aluminum.

<Crimp Terminal>

The crimp terminal 10 includes a coating crimping portion 20, a first coupling portion 30, a core crimping portion 40, a second coupling portion 50 and a contact portion 60 formed in a row along a linear direction.

Further, a linear direction from the coating crimping portion 20 toward the core crimping portion 40 and the contact portion 60 in the crimp terminal 10 is referred to as an extending direction. The extending direction is also a longitudinal direction of the insulated wire 9 on which the crimp terminal 10 is mounted.

The crimp terminal 10 is obtained by bending a metal plate material. Further, the metal plate material constituting the crimp terminal 10 is obtained by punching out a plated plate-like metal base material.

For example, the plate material constituting the crimp terminal 10 contains a base material formed of a metal material mainly containing copper such as copper or copper alloy and a metal plating formed on the surface of the base material. The material of the metal plating is, for example, a metal material mainly containing tin such as tin (Sn) or tin alloy obtained by adding silver (Ag), copper (Cu), bismuth (Bi) or the like to tin.

<Crimp Terminal: Coating Crimping Portion>

The coating crimping portion 20 is a curved plate-like part and forms a groove, into which a part of the insulation coating 92 of the insulated wire 9 is inserted, in a state before the coating crimping portion 20 is crimped to the insulated wire 9. The coating crimping portion 20 is crimped to the part of the insulation coating 92 by being bent along the periphery of the part of the insulation coating 92 inserted into that groove.

<Crimp Terminal: Contact Portion>

The contact portion 60 is a part to be directly brought into contact with an unillustrated mating terminal by being fitted to the mating terminal serving as a connection partner of the crimp terminal 10. The contact portion 60 shown in FIG. 1 is a tubular part formed with a hole into which the mating terminal is fitted. Note that the contact portion 60 may be a bar-like conductor to be fitted into a terminal insertion hole of a mating terminal.

<Crimp Terminal: First and Second Coupling Portions>

The first coupling portion 30 is a part connecting the coating crimping portion 20 and the core crimping portion 40. Further, the second coupling portion 50 is a part connecting the core crimping portion 40 and the contact portion 60. Each of the first and second coupling portions 30, 50 is a curved plate-like part and forms a groove.

<Crimp Terminal: Core Crimping Portion>

The core crimping portion 40 is a curved plate-like part forming a groove, into which an end part of the core 91 of the insulated wire 9 is inserted, in a state before the core crimping portion 40 is crimped to the insulated wire 9. The core crimping portion 40 is crimped to the end part of the core 91 inserted into the groove formed by the core crimping portion 40.

In the wire with terminal 1, the core crimping portion 40 includes a bottom plate 41 and two core caulking portions 42. The bottom plate 41 is a part for supporting the end part of the core 91 of the insulated wire 9. Further, the pair of core caulking portions 42 are parts connected to a pair of side walls formed to stand up from the bottom portion 41 toward opposite sides of the end part of the core 91.

A direction in which the bottom plate 41 and the pair of core caulking portions 42 are facing is referred to as a thickness direction. The thickness direction is a direction perpendicular to the extending direction. Further, a direction perpendicular to the extending direction and the thickness direction is referred to as a width direction. Thus, the bottom plate 41 supports the end part of the core 91 from one side in the thickness direction. In the wire with terminal 1, a thickness of the core crimping portion 40 is a so-called crimp height.

The pair of core caulking portions 42 are parts folded to sandwich the end part of the core 91 between the core caulking portions 42 and the bottom plate 41 and form ridges extending along the extending direction. The pair of core caulking portions 42 are bent in directions in which tip parts thereof are facing the bottom plate 41 and crimped to the end part of the core 91. The core crimping portion 40 shown in this embodiment is of an abutment type in which the pair of core caulking portions 42 do not overlap.

The bottom surface of the core crimping portion 40 is an outer side surface of the bottom plate 41 supporting the end part of the core 91. Further, the upper surface of the coating crimping portion 20 is composed of outer side surfaces of the pair of core caulking portions 42. Note that, in this specification, the bottom and upper surfaces of the core crimping portion 40 are used as terms for distinguishing four surfaces of the core crimping portion 40 for the sake of convenience and not related to vertical and lateral directions in a state where the wire with terminal 1 is laid.

In the following description, an end of the crimp terminal 10 on the side of the coating crimping portion 20 is referred to as a first end 101 and an end on the side of the contact portion 60 is referred to as a second end 102.

The bottom plate 41 of the core crimping portion 40 is formed to include inclined portions 441 recessed gradually deeper toward the pair of core caulking portions 42 from the side of the first end 101 toward the side of the second end 102.

Figure 2A:
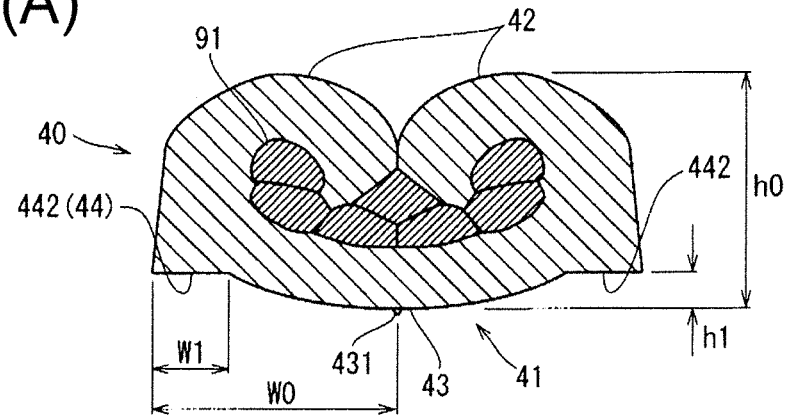
FIG. 2 is a section of the wire with terminal 1 at the position of a core crimping portion.
Figure 2B:
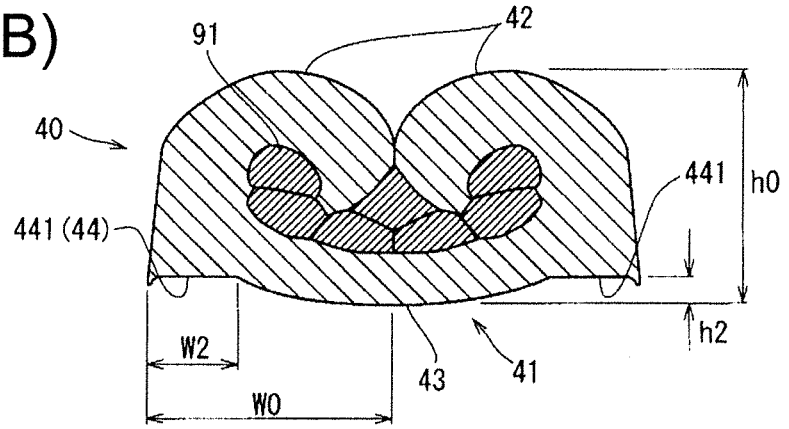
Figure 2C:
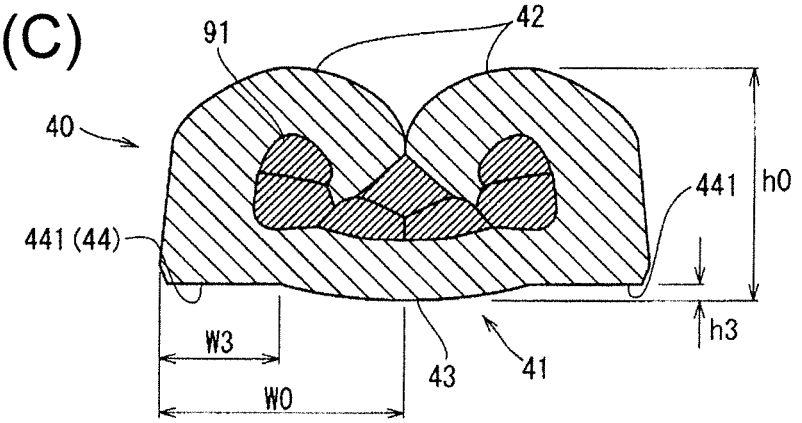

FIGS. 2(*a*), 2(*b*) and 2(*c*) are respectively sections along II-II, III-III and IV-IV of FIG. 1. More specifically, FIG. 2(*a*) is a section of the wire with terminal 1 at the position of later-described parallel portions 442 in the core crimping portion 40. The parallel portion 442 is a part closer to the second end 102 than the inclined portion 411. FIG. 2(*b*) is a section of the wire with terminal 1 at the position of the inclined portions 441 of the core crimping portion 40 near the second end 102. FIG. 2(*c*) is a section of the wire with terminal 1 at the position of the inclined portions 441 of the core crimping portion 40 near the first end 101.

In this embodiment, the bottom plate 41 of the core crimping portion 40 includes a raised portion 43 and a pair of base portions 44 and the inclined portion 441 is included in each of the pair of base portions 44.

The raised portion 43 is a part raised toward a side opposite to the core 91 in a widthwise central area. A surface of the bottom plate 41 opposite to the core 91 is an outer surface (bottom surface). The raised portion 43 is raised while forming a ridge parallel to the ridges of the pair of core caulking portions 42.

Accordingly, as shown in FIG. 2, the crimp height of the core crimping portion 40 is equal to an interval h0 between the ridges of the pair of core caulking portions 42 and that of the raised portion 43 in the thickness direction. In this case, although the bottom plate 41 includes the inclined portions 441, the crimp height of the core crimping portion 40 is constant in the extending direction except at bell-mouths 421 formed on end parts on the side of the first end 101 and on the side of the second end 102.

That the ridges of the pair of core caulking portions 42 are parallel to that of the raised portion 43 means not only that these ridges are strictly parallel, but also that these ridges are substantially parallel.

A surface of the raised portion 43 in this embodiment a curved convex surface, e.g. a convex surface having an arcuate cross-section contour. Thus, the raised portion 43 is formed to be gradually higher from the pair of base portions 44 on opposite sides thereof to a top part in the widthwise center.

Further, the pair of base portions 44 are parts including the inclined portions 441 at the opposite sides of the raised portion 43. Each of the pair of base portions 44 in this embodiment includes the inclined portion 441 and the parallel portion 442 formed at a side of the inclined portion 441 close to the second end 102. The parallel portion 442 is a part having a constant interval to the pair of core caulking portions 42 in the extending direction (longitudinal direction of the insulated wire 9).

As described above, the inclined portion 441 is formed to be recessed gradually deeper toward the pair of core caulking portions 42 from the side of the first end 101 toward the side of the second end 102.

Thus, as shown in FIG. 2, a depth h3 of the inclined portion 441 with respect to the top part of the raised portion 43 in the part of the inclined portion 441 near the first end 101 is smaller than a depth h2 of the inclined portion 441 with respect to the top part of the raised portion 43 in the part of the inclined portion 441 near the second end 102. Further, a depth h1 of the parallel portion 442 with respect to the top part of the raised portion 43 is equal to the depth of the inclined portion 441 with respect to the top part of the raised portion 43 at the end of the inclined portion 441 on the side of the second end 102.

Further, the inclined portions 441 of the pair of base portions 44 of the bottom plate 41 are formed to be recessed gradually deeper toward the pair of core caulking portions 42 and gradually wider from the side of the first end 101 toward the side of the second end 102.

Accordingly, as shown in FIG. 2, a width W3 of the part of the inclined portion 441 near the first end 101 is larger than a width W2 of the part of the inclined portion 441 near the second end 102. Further, a width W1 of the parallel portion 442 is equal to the width of the end part of the inclined portion 441 on the side of the second end 102.

Further, in this embodiment, the bottom plate 41 of the core crimping portion 40 is formed with a projection 431 as a mark of a boundary position between the inclined portions 441 and the parallel portions 442. In an example shown in FIGS. 1 to 3, the projection 431 is formed at a position corresponding to the boundary position between the inclined portions 441 and the parallel portions 442 on the ridge of the raised portion 43.

The bottom plate 41 of the core crimping portion 40 described above is formed by an anvil 81 shown in FIG. 4 when the core crimping portion 40 is crimped to the end part of the core 91. The anvil 81 is a part of a die provided in a crimping machine 8 and the core crimping portion 40 is crimped to the end part of the core 91 by the anvil 81 (lower die) and a crimper 82 (upper die) of the crimping machine 8.

Figure 4:
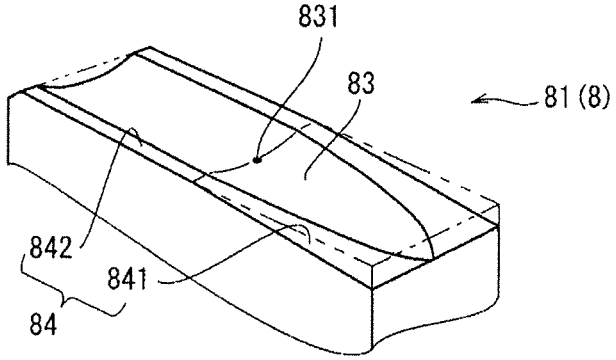
FIG. 4 is a perspective view of an anvil for forming the core crimping portion of the wire with terminal 1.

The anvil 81 shown in FIG. 4 can be easily manufactured by a simple cutting step of cutting a base material of the die.

Specifically, a groove 83 extending straight is formed in a widthwise central area on a rectangular surface of the base material of the anvil 81. A deepest part of the groove 83 is a widthwise central part of the groove 83. The groove 83 is a part for forming the raised portion 43 on the bottom plate 41 of the core crimping portion 40. Note that a contour shape of the base material of the anvil 81 before the groove 83 is formed is drawn by an imaginary line (chain double-dashed line) in FIG. 4.

At a point of time when the groove 83 is formed, the top surfaces of a pair of edge portions 84 at opposite sides of the groove 83 are flat surfaces having a width constant in a longitudinal direction of the groove 83. Further, at that point of time, a depth of the groove 83 is constant in the longitudinal direction of the groove 83. Specifically, a height difference between the deepest part of the groove 83 and the top surfaces of the pair of edge portions 84 is constant in the longitudinal direction of the groove 83. Note that the longitudinal direction of the groove 83 is a linear direction along which the groove 83 extends.

An inner side surface of the groove 83 shown in FIG. 4 is a curved concave surface, e.g. a concave surface having an arcuate cross-section contour. A process of forming the groove 83 of a constant depth extending straight in a metal member is easy.

Subsequently, parts of the pair of edge portions 84 at the opposite sides of the groove 83 in the base material of the anvil 81 are cut along a plane oblique to the originally flat top surface. In this way, the anvil 81 is completed. A process of cutting parts of the metal member along the plane is easy.

If the parts of the pair of edge portions 84 are cut along the oblique plane, the pair of edge portions 84 at the opposite sides of the groove 83 include a pair of oblique edge portions 841 having a top surface oblique to a straight line along which the deepest part of the groove 83 extends, and a pair of non-oblique edge portions 842 having a top surface parallel to the straight line along which the deepest part of the groove 83 extends.

The top surfaces of the pair of oblique edge portions 841 are inclined to gradually reduce the height difference to the deepest part of the groove 83 from a first end connected to the top surfaces of the pair of non-oblique edge portions 842 toward a second end on an opposite side.

Further, the groove 83 is formed to be gradually deeper from the pair of edge portions 84 at the opposite sides of the groove 83 to the deepest part in the widthwise center. Thus, the top surfaces of the pair of oblique edge portions 841 formed by obliquely cutting the parts of the pair of edge portions 84 become gradually wider from the first end on the side of the non-oblique edge portions 842 toward the second end.

In the anvil 81, the groove 83 is a part for forming the raised portion 43 of the bottom plate 41 of the core crimping portion 40. Further, the pair of oblique edge portions 841 are parts for forming the inclined portions 441 of the bottom plate 41 of the core crimping portion 40. Further, the pair of non-oblique edge portions 842 are parts for forming the parallel portions 442 of the bottom plate 41 of the core crimping portion 40.

Further, the anvil 81 is formed with a recess 831 in a part corresponding to a boundary position between the pair of oblique edge portions 841 and the pair of non-oblique edge portions 842 in the longitudinal direction of the groove 83. In an example shown in FIG. 4, the recess 831 is formed at a position of the deepest part of the groove 83 corresponding to the boundary position between the pair of oblique edge portions 841 and the pair of non-oblique edge portions 842. The recess 831 is a part for forming the projection 431 as the mark of the boundary position between the inclined portions 441 and the parallel portions 442 of the bottom plate 41.

Further, it is also considered to form the recess 831 or a projection for forming the mark of the above boundary position on one or both of the pair of edge portions 84 of the anvil 81. In this case, the projection 431 or a recess as the mark of the above boundary position is formed on one or both of the pair of base portions 44 on the bottom plate 41.

<Crimping Step of Core Crimping Portion>

Figure 5:
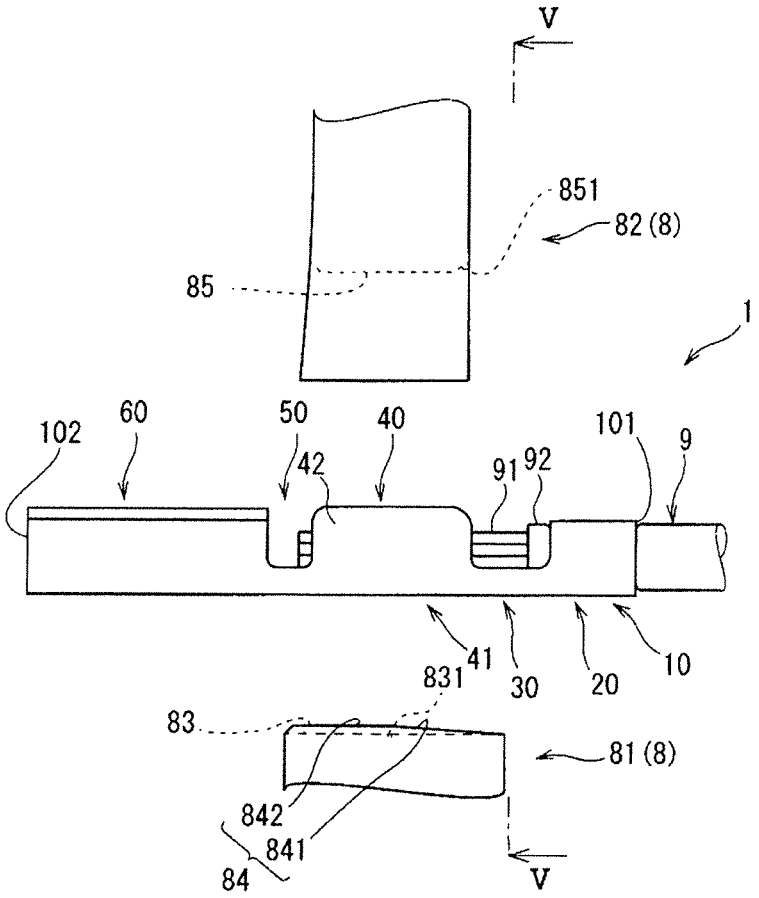
FIG. 5 is a side view of a crimp terminal, an insulated wire, the anvil and a crimper in a crimping step.
Figure 6:
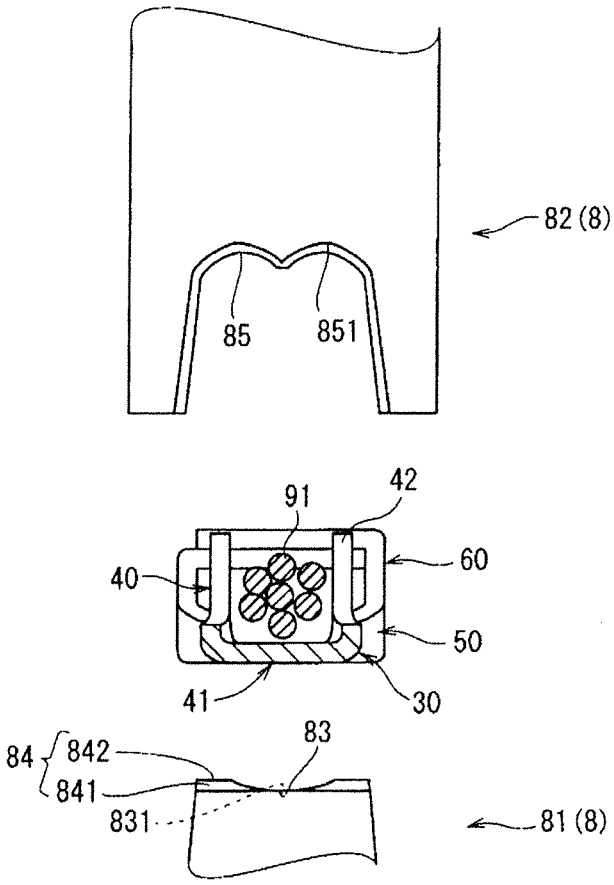
FIG. 6 is a section of the crimp terminal and the insulated wire and a rear view of the anvil and the crimper in the crimping step.

Next, a crimping step of the core crimping portion 40 as a part of a manufacturing process of the wire with terminal 1 is described with reference to FIGS. 5 and 6. FIG. 5 is a side view of the crimp terminal 10, the insulated wire 9, the anvil 81 and the crimper 82 in the crimping step. FIG. 6 is a section of the crimp terminal 10 and the insulated wire 9 and a rear view of the anvil 81 and the crimper 82 in the crimping step.

As shown in FIGS. 5 and 6, the crimping machine 8 is provided with the anvil 81 (lower die) and the crimper 82 (upper die). In the crimping step, the end part of the core 91 is arranged between the pair of core caulking portions 42 in the core crimping portion 40. In that state, the core crimping portion 40 of the crimp terminal 10 is pressed by being sandwiched between the anvil 81 arranged to face the bottom plate 41 and the crimper 82 arranged to face the pair of core caulking portions 42.

A forming surface 85 of the crimper 82 includes a pair of groove-like curved surfaces for folding the pair of core caulking portions 42 toward the bottom plate 41. In an example shown in FIGS. 5 and 6, the forming surface 85 of the crimper 82 further includes bell-mouth forming surfaces 851 for forming the bell-mouths 421 on opposite end parts of the pair of core caulking portions 42.

When the core crimping portion 40 is sandwiched between the anvil 81 and the crimper 82, the pair of core caulking portions 42 are folded to sandwich the end part of the core 91 between the core caulking portions 42 and the bottom plate 41 and form the ridges extending in the extending direction. In this way, tip parts of the pair of core caulking portions 42 are caulked to the end part of the core 91. Further, the ridges formed by the pair of folded core caulking portions 42 are parallel to the extending direction.

Further, by sandwiching the core crimping portion 40 between the anvil 81 and the crimper 82, the bottom plate 41 of the core crimping portion 40 is shaped to include the raised portion 43, the inclined portions 441, the parallel portions 442 and the projection 431 as described above.

Effects

In the wire with terminal 1, the bottom plate portion 41 of the core crimping portion 40 is shaped to include the inclined portions 441 recessed gradually deeper toward the pair of core caulking portions 42 from the side of the first end 101 to the side of the second end 102 of the crimp terminal 10. Specifically, as shown in FIGS. 1 and 2, parts of the core crimping portion 40 where the inclined portions 441 are formed are so crimped that a degree of compression of the core 91 gradually increases from the side of the first end 101 to the side of the second end 102.

Specifically, the inclined portions 441 of the core crimping portion 40 are formed to be recessed deeper toward the pair of core caulking portions 42 as they extend toward the second end 102 as shown in FIGS. 1 and 2. Thus, as shown in FIG. 2, the core crimping portion 40 is so crimped that mainly opposite widthwise sides of the core 91 are compressed to a larger degree toward the second end 102, i.e. the compression ratio of the core 91 is gradually reduced toward the second end 102.

Accordingly, if the wire with terminal 1 is adopted, it is possible to crimp parts near the first end 101 out of the parts of the core crimping portion 40 where the inclined portions 441 are formed with strength mainly suitable to increase the fixing force and crimp parts near the second end 102 with strength mainly suitable to reduce connection resistance.

Figure 7:
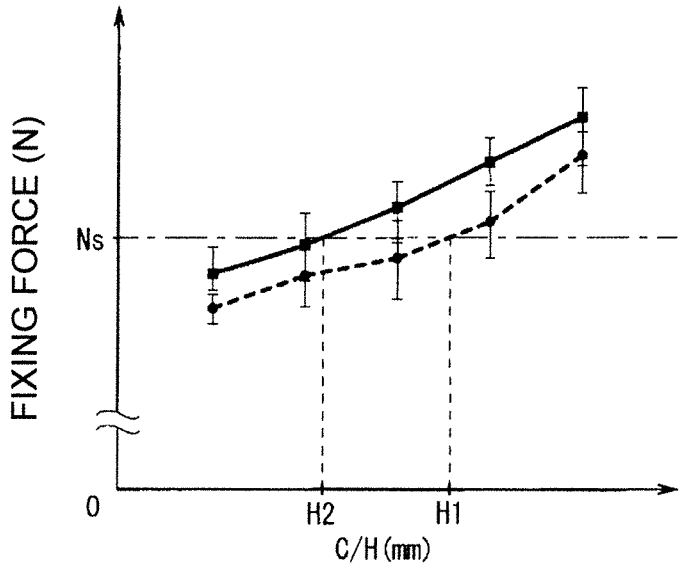
FIG. 7 is a graph showing a relationship of a crimp height and a fixing force in the wire with terminal 1 and a conventional wire with terminal.

A graph shown in FIG. 7 is a graph showing a relationship of the crimp height (C/H) and the fixing force in the wire with terminal 1 and a conventional wire with terminal. In the graph of FIG. 7, a solid-line graph line represents a measurement result for the wire with terminal 1 and a broken-line graph line represents a measurement result for the conventional wire with terminal. Further, a core crimping portion of the conventional wire with terminal as a comparison object has such a structure that the inclined portions 441 of the core crimping portion 40 of the wire with terminal 1 are replaced by the parallel portions 442, i.e. such a structure that the pair of base portions 44 are entirely the parallel portions 442.

Further, a measurement range for the crimp height shown in the graph of FIG. 7 is a range where connection resistance sufficiently low to satisfy required specifications is obtained in both the wire with terminal 1 and the conventional wire with terminal.

As shown by the graph of FIG. 7, the fixing force increases as the crimp height increases in the range of the crimp height where the connection resistance can be suppressed to a sufficiently low level in both the wire with terminal 1 and the conventional wire with terminal. Note that a large crimp height means a small degree of compression of the core, i.e. a large compression ratio of the core.

Further, the graph of FIG. 7 shows that the fixing force of the core crimping portion 40 in the wire with terminal 1 is larger than that of the core crimping portion in the conventional wire with terminal under the condition that the crimp height is equal.

Accordingly, as shown in the graph of FIG. 7, an allowable lower limit value H2 of the crimp height in the wire with terminal 1 is drastically smaller than an allowable lower limit value H1 of the crimp height in the conventional wire with terminal under the condition that the fixing force is not smaller than a required lower limit value Ns. Specifically, the wire with terminal 1 has a wider range of the crimp height allowable to obtain the required fixing force as compared with the conventional wire with terminal.

As a result of the above, it becomes easier to manage parameters of the crimping step in the manufacturing of the wire with terminal 1 and combine small connection resistance and a large fixing force. Particularly, if the core 91 of the insulated wire 9 is a conductor mainly containing aluminum, an effect of easily combining the connection resistance and the fixing force is more notable.

Further, the shapes of the inclined portions 441 forming recesses on the bottom plate 41 of the core crimping portion 40 moderately change in the longitudinal direction of the insulated wire 9. Thus, even if the anvil 81 (lower die) for forming such inclined portions 441 is pressed against the bottom plate 41 in the crimping step of the core crimping portion 40, the bottom plate 41 is unlikely to be cracked.

Note that it is considered to form relatively large steps on a bottom plate portion of the second coupling portion 50 in the wire with terminal 1. However, the second coupling portion 50 is a part not pressed by the crimping machine 8. Specifically, the second coupling portion 50 is a part to which a large shear force is not applied. Thus, the second coupling portion 50 is unlikely to be cracked.

Further, in the wire with terminal 1, the bottom plate 41 of the core crimping portion 40 includes the raised portion 43 occupying the widthwise central area and the pair of base portions 44 located at the opposite sides of the raised portion 43, and the inclined portion 441 is included in each of the pair of base portions 44. Furthermore, the ridges of the pair of core caulking portions 42 and that of the raised portion 43 on the bottom plate 41 are parallel.

Accordingly, although the inclined portions 441 are formed on the bottom plate 41 of the core crimping portion 40, the crimp height of the core crimping portion 40 is constant in the longitudinal direction of the insulated wire 9. Generally, a crimp height is an important inspection parameter for a crimped state of a crimp terminal. If the wire with terminal 1 is adopted, a degree of freedom in the measurement position of the crimp height is high. Thus, the crimp height is easily inspected.

Further, the inclined portions 441 of the pair of base portions 44 are formed to be recessed gradually deeper toward the pair of caulking portions 42 and gradually wider from the side of the first end 101 toward the side of the second end 102. As shown in FIG. 4, the anvil 81 (lower die) for forming such inclined portions 441 can be easily manufactured by a step of forming the groove 83 having a constant cross-sectional shape in the metal member and a step of obliquely cutting the pair of edge portions 84 at the opposite sides of the groove 83.

Further, the bottom plate 41 of the core crimping portion 40 includes the inclined portions 441 and the parallel portions 442 formed at the sides of the inclined portions 441 close to the second end 102. In this case, in the parts of the core crimping portion 40 including the parallel portions 442, the compression ratio of the core 91 is substantially equal in a cross-section at any position in the longitudinal direction of the insulated wire 9. The compression ratio of the core 91 is an important inspection parameter for the crimped state of the crimp terminal. If the wire with terminal 1 is adopted, a degree of freedom in the measurement position of the compression ratio of the core 91 is high. Thus, the compression ratio of the core 91 is easily inspected.

Further, if an angle of the inclined portions 441 to the parallel portions 442 is very small, it is difficult to visually distinguish the parallel portions 442 and the inclined portions 441. Thus, it is difficult to specify the measurement position of the compression ratio of the core 91. In the wire with terminal 1, the bottom plate 41 of the core crimping portion 40 is formed with the projection 431 as the mark of the boundary position between the inclined portions 441 and the parallel portions 442. As a result, the measurement position of the compression ratio of the core 91 is easily specified by distinguishing the parallel portions 442 and the inclined portions 441.

Figure 3:
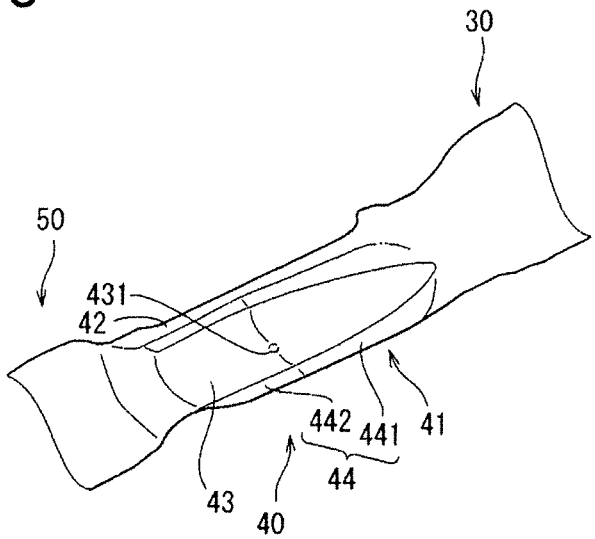
FIG. 3 is a perspective view of a bottom plate portion of the core crimping portion in the wire with terminal 1.
Figure 8:
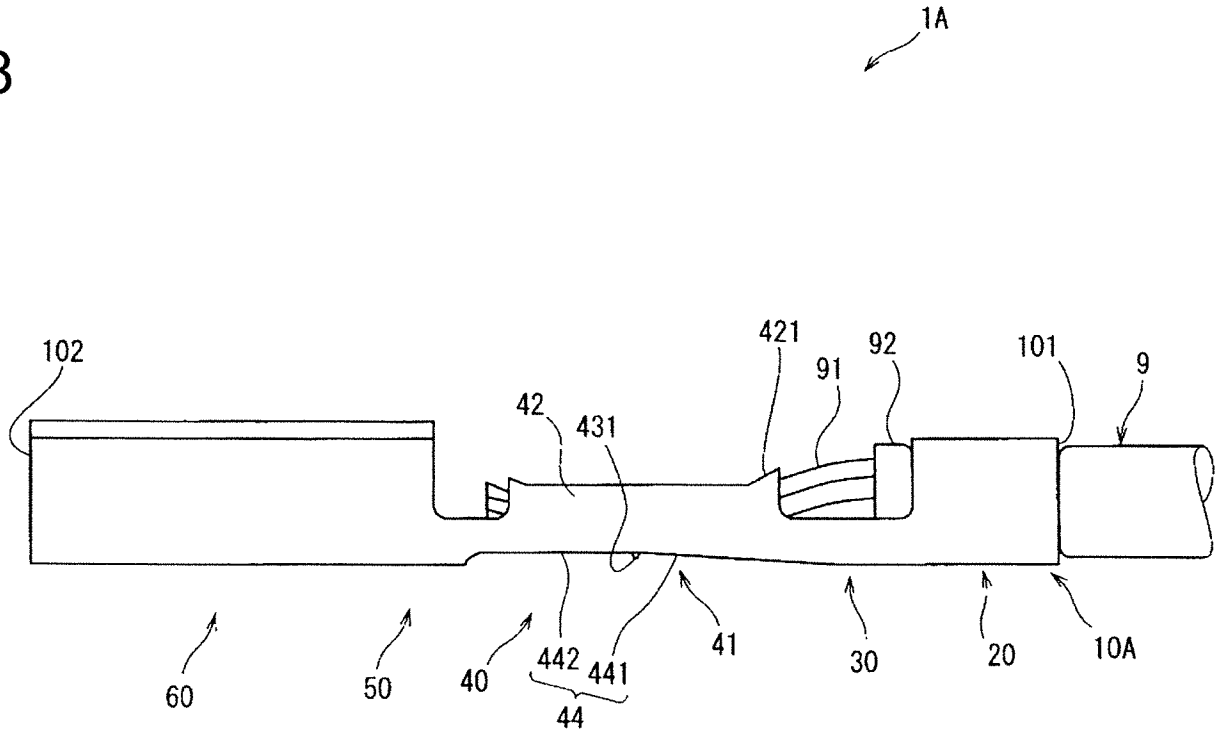
FIG. 8 is a section of a wire with terminal 1A according to a second embodiment.

Next, a wire with terminal 1A according to a second embodiment is described with reference to FIG. 8. As compared with the wire with terminal 1 shown in FIGS. 1 to 3, the wire with terminal 1A has a configuration in which the raised portion 43 of the bottom plate 41 of the core crimping portion 40 is omitted. In FIG. 8, the same constituent elements as those shown in FIGS. 1 to 3 are denoted by the same reference signs. Only points of difference of the wire with terminal 1A from the wire with terminal 1 are described below.

The wire with terminal 1A includes an insulated wire 9 and a crimp terminal 10A mounted on an end of the insulated wire 9. A bottom plate 41 of the crimp terminal 10A includes an inclined portion 441 and a parallel portion 442. However, the inclined portion 441 of the crimp terminal 10A is formed over the entire width of the bottom plate 41. Similarly, the parallel portion 442 of the crimp terminal 10A is also formed over the entire width of the bottom plate 41.

Also in the case of adopting the wire with terminal 1A, an effect that small connection resistance and a large fixing force are easily combined and the core crimping portion 40 is unlikely to be cracked in a crimping step is obtained as in the case of adopting the wire with terminal 1.

Since the core crimping portion 40 of the wire with terminal 1A is also formed with the parallel portion 442, a crimp height is easily measured.

Note that the bottom plate 41 of the crimp terminal 10A is also formed with a projection 431 as a mark of a boundary position between the inclined portion 441 and the parallel portion 442.

<Application>

In the wire with terminals 1, 1A, the mark of the boundary position between the inclined portion(s) 441 and the parallel portion(s) 442 is also conceivably a recess. Further, in the wire with terminal 1, it is also considered to form the projection 431 or the recess as the mark of the boundary position between the inclined portions 441 and the parallel portions 442 on one or both of the pair of base portions 44.

Further, the anvil 81 conceivably includes a projection instead of the recess 831. In this case, the mark of the boundary position between the inclined portions 441 and the parallel portions 442 formed on the bottom plate 41 is a recess. However, in the anvil 81, the recess 831 is considered to have better durability than the projection.

Note that the wire with terminal according to the present invention can be also configured by freely combining the respective embodiments and applications described above or appropriately modifying the respective embodiments and applications or omitting partial elements of the respective embodiments and applications.

LIST OF REFERENCE SIGNS

1, 1A wire with terminal
8 crimping machine
9 insulated wire
10, 10A crimp terminal
20 coating crimping portion
30 first coupling portion

40 core crimping portion
41 bottom plate of core crimping portion
42 core caulking portion
43 raised portion
44 base portion
50 second coupling portion
60 contact portion
81 anvil
82 crimper
83 groove
84 edge portion
85 forming surface of crimper
91 core
92 insulation coating
101 first end of crimp terminal
102 second end of crimp terminal
411 inclined portion
421 bell-mouth
431 projection (mark) of bottom plate portion
441 inclined portion
442 parallel portion
831 recess of anvil
841 oblique edge portion
842 non-oblique edge portion
851 bell-mouth forming surface

The invention claimed is:

1. A wire with terminal, comprising:

an insulated wire; and a crimp terminal including a core crimping portion crimped to an end part of a core of the insulated wire, a coating crimping portion formed on a first end side and crimped to a part of an insulation coating of the insulated wire, and a contact portion formed on a second end side and to be connected to a mating terminal, wherein:

the core crimping portion includes a bottom plate for supporting the core and two core caulking portions folded to sandwich the core between the core caulking portions and the bottom plate and form ridges extending along a longitudinal direction of the insulated wire;

the bottom plate of the core crimping portion is shaped to include an inclined portion recessed gradually deeper toward the caulking portions from the first end side toward the second end side;

the bottom plate of the core crimping portion includes a raised portion raised toward a side opposite to the core in a widthwise central area while forming a ridge parallel to the ridges of the pair of caulking portions and two base portions that are parts including the inclined portions at opposite sides of the raised portion; and the inclined portions of the base portions on the bottom plate of the core crimping portion are formed to be recessed gradually deeper toward the caulking portions and are gradually wider from the first end side toward the second end side.

2. A wire with terminal according to claim 1, wherein:

the base portions on the bottom plate of the core crimping portion further include parallel portions formed at sides of the inclined portions close to the second end side and having a constant interval to the pair of caulking portions in the longitudinal direction of the insulated wire.

3. A wire with terminal according to claim 2, wherein:

the bottom plate of the core crimping portion is formed with a projection or a recess as a mark of a boundary position between the inclined portion and the parallel portion.

* * * * *